United States Patent [19]

Bolton et al.

[11] Patent Number: 5,052,888

[45] Date of Patent: Oct. 1, 1991

[54] DC MOTOR DRIVEN CENTRIFUGAL FAN

[75] Inventors: Ivor W. Bolton, Winchester; David S. Gaunt, Southampton; Ronald K. Russell, Swindon, all of England

[73] Assignee: IBM Corporation, Armonk, N.Y.

[21] Appl. No.: 551,967

[22] Filed: Jul. 11, 1990

[51] Int. Cl.[5] ..... F01D 9/00

[52] U.S. Cl. ..... 415/182.1; 415/119; 415/206

[58] Field of Search ..... 415/119, 203, 204, 205, 415/206, 182.1, 200, 213.1, 214.1

[56] References Cited

U.S. PATENT DOCUMENTS

| | | | |
|---|---|---|---|
| 2,160,666 | 5/1939 | McMahan | 415/119 |
| 2,749,024 | 6/1956 | Wilfert | 415/200 |
| 3,561,906 | 2/1971 | Fermer | 415/206 |
| 3,627,442 | 12/1971 | Brandt | 415/214.1 |
| 3,698,833 | 10/1972 | Cann et al. | 415/204 |
| 3,732,030 | 5/1973 | Mullings | 415/214.1 |
| 3,775,029 | 11/1973 | Ranz | 415/206 |
| 4,419,049 | 12/1983 | Gerboth et al. | 415/119 |
| 4,959,571 | 9/1990 | Yasumoto et al. | 415/119 |

FOREIGN PATENT DOCUMENTS

| | | | |
|---|---|---|---|
| 0066618 | 3/1953 | Canada | 415/205 |
| 0569171 | 10/1930 | Fed. Rep. of Germany | 415/206 |
| 1305648 | 8/1962 | France | 415/206 |
| 46-13901 | 4/1971 | Japan | 415/206 |
| 0055400 | 3/1988 | Japan | 415/119 |
| 0370370 | 4/1973 | U.S.S.R. | 415/206 |
| 0047811 | 11/1978 | U.S.S.R. | 415/206 |
| 2185074 | 7/1987 | United Kingdom | 415/119 |

*Primary Examiner*—Edward K. Look
*Assistant Examiner*—Christopher M. Verdier
*Attorney, Agent, or Firm*—Andrew J. Dillon

[57] ABSTRACT

A centrifugal fan includes a brushless d.c. motor, an impeller mounted on the motor and a scroll on which the motor is mounted. The scroll defines the air inlet and outlet and has an outer wall curved around the impeller to define a divergent air flow path. By truncating the scroll at the outlet substantially to eliminate any flat portions on the outer wall susceptible to mechanical vibrations at frequencies excited by the d.c. motor, a noise reduction is achieved. Further noise reduction may be achieved by resiliently mounting the motor on the scroll.

11 Claims, 5 Drawing Sheets

DC MOTOR DRIVEN CENTRIFUGAL FAN

This invention relates to d.c motor driven centrifugal fans for low noise applications.

BACKGROUND OF THE INVENTIONS

Brushless d.c motors have a number of advantages when used to drive centrifugal fans in terms of safety, flexibility of performance and low power consumption as compared to a.c motors. They allow lower speed operation which reduces aerodynamic noise and they have the flexibility to match the air flow to the system cooling requirements by changing the fan speed at will.

However, brushless d.c fans suffer from three major disadvantages when used in low noise level applications; namely discrete tones generated at the blade passing frequencies, bearing noise and tones produced by motor vibrations at harmonics of the DC motor torque pulsation frequency. The latter is more predominant the quieter the broad band aerodynamic noise, and can be a limiting factor in minimising installed fan noise. In addition the rotational speed of a DC fan can vary with back pressure depending on the motor design and this can cause a wide variation in noise level as the motor pulsation frequency may coincide with the motor and fan structural vibration modes.

Motor noise on any application has a higher priority if a low speed impeller design is used when the aerodynamic noise can be reduced to a minimum. The advantages of BLDC motors, in terms of noise, can be problematical. Firstly, since the motor is synchronous at all speeds is capable of producing high accelerating torque during start up. This results in high currents which in conjunction with the large di/dt associated with a square waveform can generate acoustical noise at harmonics of the pulsation frequency. The wave form can only be smoothed by use of additional components leading to increased cost and reduced reliability.

The high starting current can be limited by an increase in magnetic reluctance but this results in increased motor speed with load. A phenomenon of centrifugal fans is that the motor load varies inversely with changing back pressure, increasing speed and aerodynamic noise. Although such speed variations may be a disadvantage in terms of noise, significant benefits are offered to a designer who requires constant airflow at a varying system static pressure loss.

The motor design is therefore a compromise between conflicting requirements of cost, air flow performance and acoustics, the latter being determined by the interaction between the motor and the fan structure.

This aspect of fan design is discussed further in a paper entitled "Control of fan acoustic noise through motor design" (Hsien-Sheng Pei, Internoise 88). Other aspects of fan noise are discussed in a paper entitled "Fan noise—Generation Mechanisms and Control Methods" (W. Neise, Internoise 88).

Various solutions to the problems of noise control in centrifugal fans have been proposed in the prior art. In GB patent No. 1421207, for a "Rotary Blower Arrangement," a unitary assembly of a drum-rotor impeller and drive motor is mounted on the blower casing by means of an angle bar. The angle bar is connected to a scroll, forming part of the housing, by elastic material vibration dampers so that excitation of the blower casing is reduced.

In GB patent application 2055969A for a "Low Noise Centrifugal Blower", a curved "cut-off" portion at the termination of the involute wall portion at the blower outlet is replaced by a linear extension wall portion to eliminate a discrete operating whistle. There is, however, no overall reduction in noise levels and the whistle eliminated is purely aerodynamic in origin.

Finally, to complete the review of the prior art, an a.c motor fan scroll which is cut back from the conventional fully developed form has been employed in the IBM 9335 Model BO1 disk storage unit. In the 9335, dual impellers and scrolls are mounted to either side of a central a.c motor which is itself supported on a separate fan housing. The fan scrolls were cut back in the 9335 purely so that they could be fitted into the available space and attached to a common plate. An airstream splitting arrangement is attached to the opposite side of the plate to split and direct the emergent airstream to different parts of the disk storage unit. A.c motor fans have much simpler resonance problems than d.c motor fans and these are cured relatively simply in the 9335 by resiliently mounting the motor on the fan housing to isolate the housing from mains frequency vibration.

DISCLOSURE OF THE INVENTION

The prior art has therefore failed to provide a simple way of reducing noise in a centrifugal d.c motor driven fan which is effective over a wide range of operating conditions.

Accordingly, the present invention provides a centrifugal fan comprising a brushless d.c. motor; an impeller mounted on the motor for rotation thereby; and a scroll, on which the motor is mounted, the scroll defining an air inlet and outlet and including an outer wall curved around the impeller to define a divergent path to the outlet for air driven by the impeller, the scroll further being truncated at the outlet so as substantially to eliminate any flat portions on the outer wall susceptible to mechanical vibration at frequencies excited by the d.c. motor.

The elimination of flat radiating surfaces at the scroll outlet, leaving only curved portions, has been found to reduce the number and amplitude of modes of vibration at frequencies low enough to be excited by a d.c. motor with a consequent reduction in noise emission. Preferably the scroll outer wall is curved along its entire length but it has been found that a relatively short flat portion may be included at the outlet as long as it does not become excited by motor pulsation frequencies.

The preferred outlet shape is a substantially rectangular aperture, the plane of which is closest to the impeller along a line intermediate the circumferentially spaced edges of the aperture. This may be thought of as an angled cutback (typically 45°) as compared to the included angle of 90° in a normal fully developed scroll. Clearly, other angles may be used and the outlet shape need not be rectangular.

However, the rectangular shape does facilitate attachment of the fan by its scroll to a mounting plate by means of coplanar outwardly extending flanges and is thus preferred.

It is also preferable that the scroll includes two side walls each of which is apertured to provide an air inlet. This allows a lower fan inlet air velocity for a given volume of air thus reducing aerodynamic noise.

To further quieten the fan, it is preferred that a motor should additionally be resiliently mounted on the scroll.

This can reduce the other resonances not affected by the outlet shape.

Many forms of resilient mounting may be chosen but the preferred one includes a motor support frame resiliently supported from a side wall of the scroll and extending axially into the scroll, within the impeller, to support the motor.

This is preferably implemented as an outer plate, co-extensive with the side wall and a cage portion extending axially into the scroll and being rigidly connected to the motor. The resilient connection is provided by circumferentially disposed vibration isolators between the outer plate and scroll side wall. If the outer plate is annular in shape, then obstruction of an air inlet in the scroll side wall can be minimised.

As an alternative to the above, the motor support frame can be made of an elastomeric material to provide vibration isolation.

BRIEF DESCRIPTION OF THE DRAWINGS

The invention will now be described in more detail with reference to the accompanying drawings in which.

DETAILED DESCRIPTION OF THE INVENTION

Figure 1:
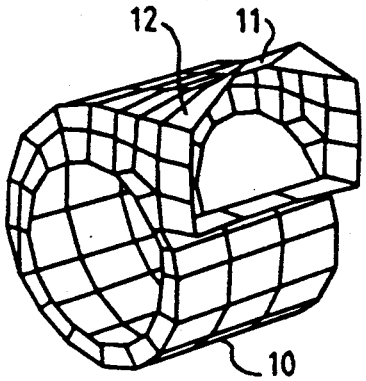
FIG. 1 is a computer model for purposes of comparison of a fully developed scroll illustrating a particular mode of vibration excited by a d.c fan motor.
Figure 2:
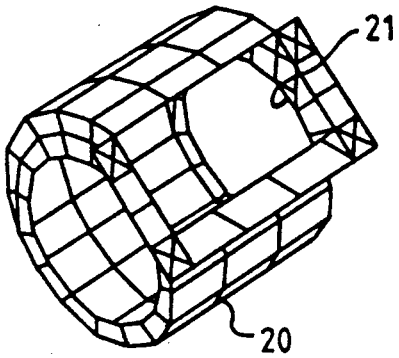
FIG. 2 is a computer model of a truncated scroll employed in a centrifugal fan according to the present invention; illustrating a particular mode of vibration excited by the d.c fan motor.

FIGS. 1 and 2 show vibrational mode models produced by computer aided design analysis for a fully developed scroll 10 and for a truncated scroll 20 according to the inventions.

Preliminary design studies determined the impeller diameter and scroll size required to meet the air flow specification and the first prototype units for design verification testing were made with the fully developed scroll of FIG. 1 and with the motor/impeller assembly hard mounted to the scroll. Initial measurements showed that the 'A' weighted sound power varied considerably with fan operating pressure, with a prominent discrete tone at 470 Hz present at free flow, decreasing rapidly with increase in back pressure and then becoming even more predominant as the back pressure was further increased. At free flow when the fan speed was 1175 rpm., 470 Hz corresponded to the 6th harmonic of the motor torque pulsation frequency.

In order to understand the interaction between the scroll of FIG. 1 and the pulsation frequency, a computer aided design analysis was made to calculate the vibrational modes of the scroll. This showed that the 5th mode occurred at a frequency of 477.49 Hz which was in close agreement with the tone produced by the fan at free flow.

Figure 3:
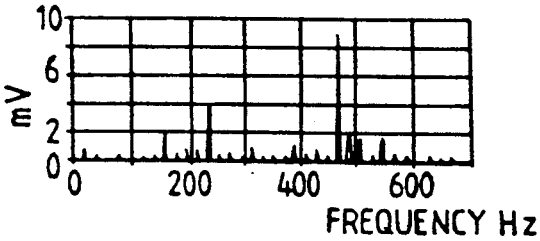
FIG. 3 illustrates the vibration of a scroll similar to that of FIG. 1 when hard-mounted to a d.c fan motor.
Figure 4:
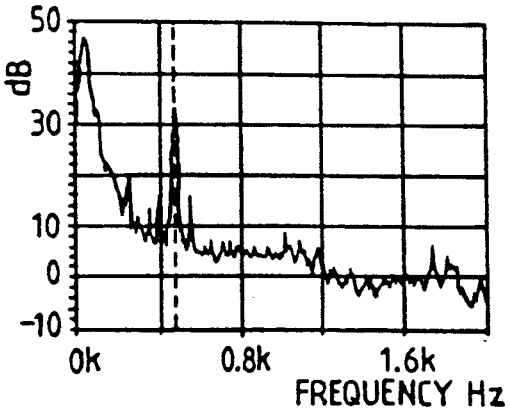
FIG. 4 shows the variation of sound pressure level (narrow band) for the same fan arrangement as FIG. 3.

The analysis was confirmed by the vibration and acoustic measurements given in FIG. 3 and 4.

As the fan back pressure is increased, the fan rpm increases and the motor pulsation frequency is effectively de-coupled from the scroll resonant modes until such time that the fan rpm is high enough for the next pulsation harmonic to match the scroll. Since the motor rpm increased rapidly with back pressure there were several peaks in the sound power vs back pressure curve which had to be reduced in order to meet the design requirements.

Several alternative methods of controlling the motor pulsation noise were considered:

1. Motor Speed control.
2. Change in scroll design to change mode frequency and shape.
3. Motor/impeller vibration isolation.

Although in theory motor speed control could be used in such a way that the pulsation frequency harmonics are midway between the scroll resonant modes, this was not a practical proposition since the scroll mode frequencies will change with fan application due to structural differences in fan mounting arrangements. Fan speed would therefore have to be "tuned" for every application with little latitude for any speed change for performance reasons without the attendant risk of a discrete tone. The design analysis identified that the 'free' edge 11 of the scroll suffered the maximum displacement, as shown in FIG. 1 with many low frequency modes coincident with motor pulsation harmonics. With the recognition that the motor pulsation harmonics had died away by the 7th, two scroll design changes to reduce the number of vibration modes below 650 Hz to a minimum were considered.

The first, a double thickness fully developed scroll, raised mode frequencies, but, as in the previous design suffered large amplitude displacements along the free edge 11.

The second, a 45° cutback on the outlet 21, eliminated the flat noise radiating area 12 and had only two modes below 650 Hz with little vibration along the free edge to excite the fan mounting structure.

Since any further increase in the resonant mode frequencies would require a considerable increase in scroll stiffness, increasing fan costs, the optimum solution was the cut-back scroll combined with vibration isolation of the motor/impeller assembly to reduce motor induced vibration to a minimum.

The motor isolation design was constrained by fan application requirements, the final choice being a grommet isolator with radial and axial resonant frequencies as low as possible. These were controlled by the motor-/impeller weight and the need for dimensional stability between impeller and scroll for reasons of performance and aerodynamic noise. The final grommet selected had calculated axial and radial resonant frequencies of 287 and 609 Hz respectively.

Figure 5:
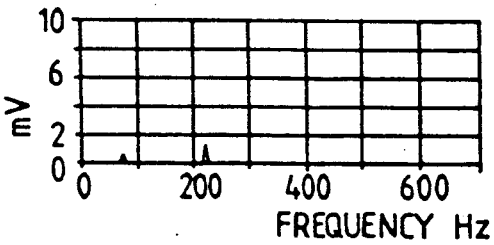
FIG. 5 illustrates the vibration of a scroll similar to that of FIG. 2 when resiliently mounted to a d.c fan motor.
Figure 6:
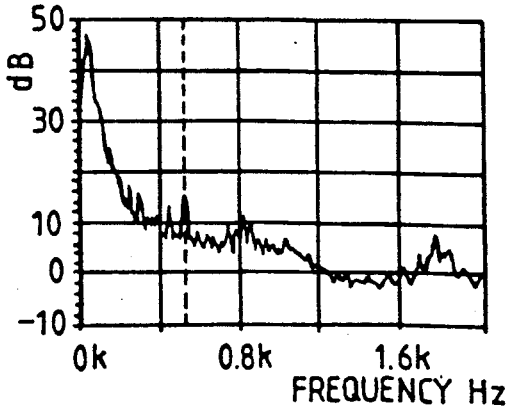
FIG. 6 illustrates the variation of sound pressure level (narrow band) for the same fan arrangement as that of FIG. 5.

Vibration and acoustic measurements for the selected cut back scroll (FIG. 2) with resiliently mounted motor are shown in FIGS. 5 and 6 and confirm the design analysis predictions.

The following table gives a comparison of the modal frequencies of the three scroll designs, as predicted by the computer aided design model, with the motor pulsation harmonies.

| MOTOR PULSATION | | | SCROLL MODAL FREQUENCY | | | | | |
|---|---|---|---|---|---|---|---|---|
| | | | | | DOUBLE | | | |
| HARMONIC | SPEED rpm | | ORIGINAL | | THICKNESS | | 45° OUTLET | |
| 1 | 1175 | 1400 | MODE | Hz | MODE | Hz | MODE | Hz |
| 2 | | | 1 | 26.8 | 1 | 52.3 | | |
| | 78.3 | 93.3 | 2 | 70.8 | 2 | 94.9 | | |
| 4 | 156.7 | 186.7 | | | | | 1 | 232.1 |
| 5 | 235.0 | 280.0 | | | | | | |
| 6 | 313.3 | 373.3 | 3 | 336.2 | | | | |
| | 391.7 | 466.7 | 4 | 407.5 | | | | |
| | 470.0 | 560.0 | 5 | 477.5 | 3 | 547.9 | 2 | 506.4 |
| | | | | | 4 | 585.5 | 3 | 676.1 |
| | | | | | 5 | 863.3 | 4 | 887.2 |
| | | | | | | | 5 | 926.4 |

Figure 7:
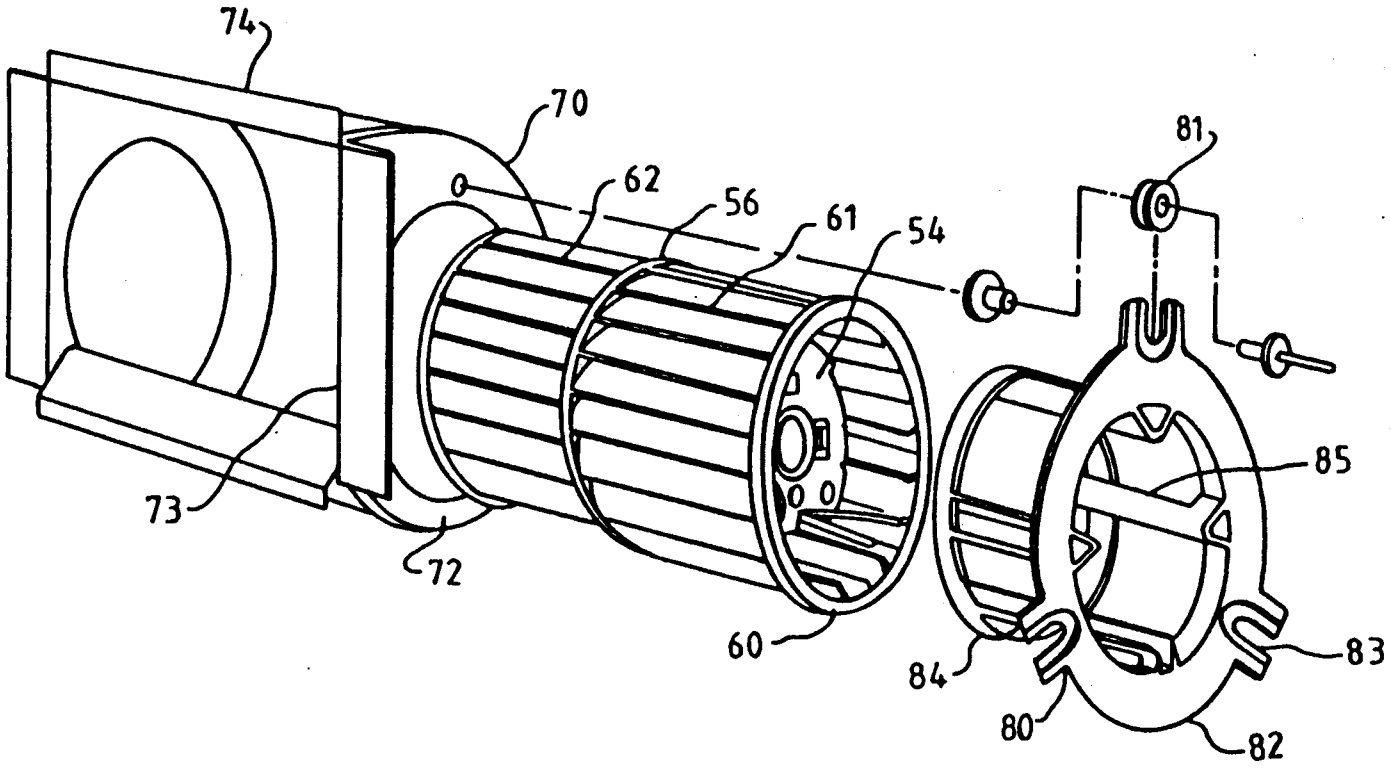
FIG. 7 shows an exploded isometric view of a centrifugal fan according to the present invention.
Figure 8:
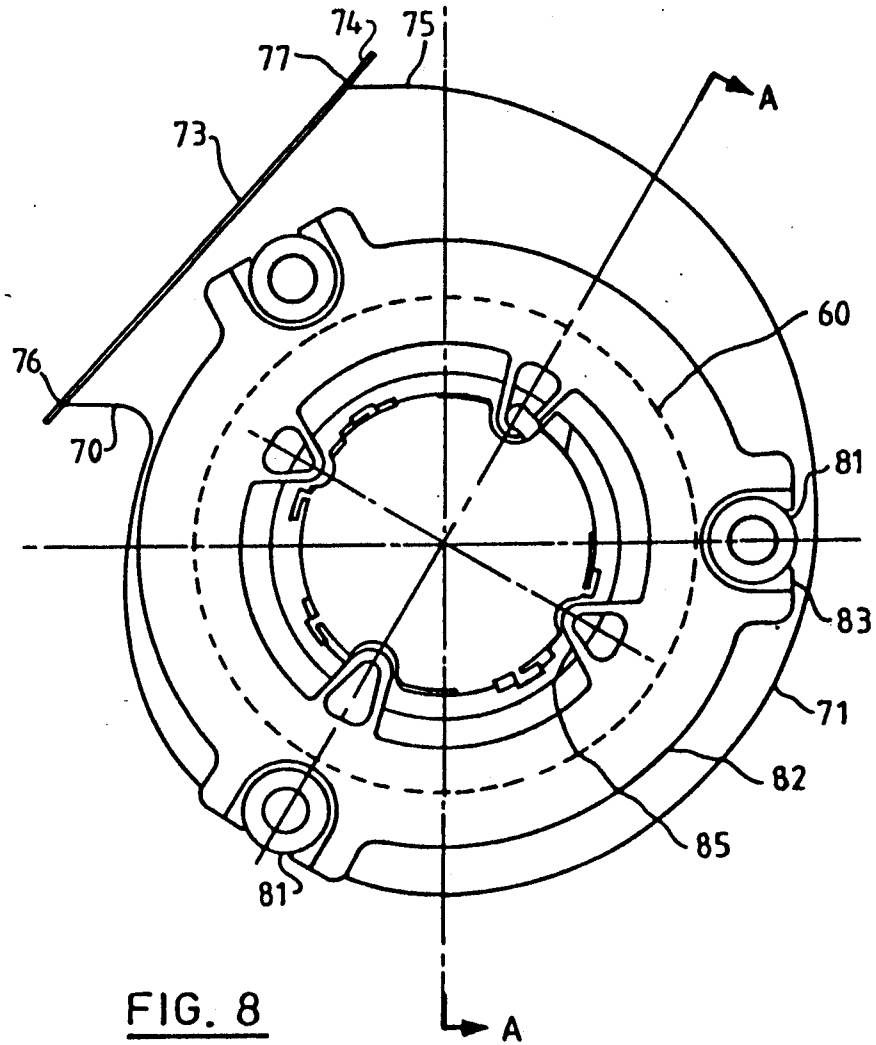
FIG. 8 shows a side elevation of the fan of FIG. 7.
Figure 9:
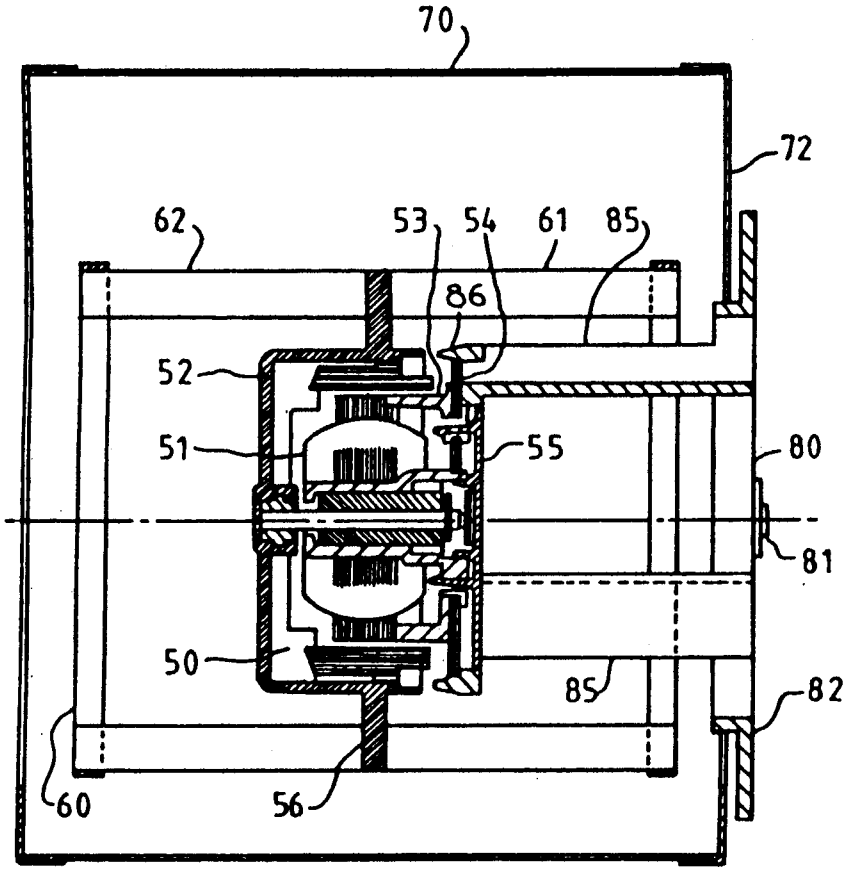
FIG. 9 shows a section taken on the line A—A of FIG. 8.

A d.c motor driven fan according to the invention is illustrated in FIGS. 7, 8 and 9. At the heart of the fan is a brushless d.c motor 50 of the kind described in International Patent Application, publication no WO88/07285. The motor consists of a stator 51, rotor 52, and a support body 53 providing a bearing housing for the rotor shaft and integrally moulded with a printed circuit board 54 carrying the electronic components of the motor. The motor is completed by a cover plate 55 (not shown in FIG. 7).

The motor rotor is attached by means of a central annular web 56 to an impeller 60, best seen in FIG. 7. The impeller blades 61, 62 on each side of the central web are offset at half pitch in order to reduce tones at the blade passing frequency.

Surrounding the impeller 60 is a scroll 70 from one side of which the motor/impeller assembly is mounted by means of mounting frame 80. The scroll consists of a curved outer wall 71, surrounding the impeller, and side wall potions 72 which are apertured to provide dual air inlets to the motor. The scroll defines a divergent path for air driven by the impeller to an outlet 73, which is rectangular in shape. Out-turned flanges 74 surrounding the outlet enable the fan to be mounted on a mounting plate or bulkead, for example by spot welding.

As has been discussed above in terms of the models of FIGS. 1 and 2, the shape of the outer wall 71 is key to achieving the reduction in noise from motor induced vibration. Rather than fully developing the scroll as in a conventional fan and as modelled in FIG. 1, so that after approximately 270° of curvature the outer surface of the scroll is continued linearly until a perpendicular dropped from its outer edge would be tangential to or would clear the lower curved portion of the scroll, the scroll 70 is truncated at an angle of approximately 45° as viewed in FIG. 8. This substantially eliminates all but a small linear portion of the scroll outer wall and, with it, the flat surface prone to vibrate at frequencies excited by motor 50. Ideally, the scroll outer wall should consist only of a curved surface, as in the model of FIG. 2, but the small linear continuation 75 of the otherwise curved surface 71 has been found not to be a source of significant acoustic radiation.

The cutback of outlet 73 results in the plane of the outlet lying closest to the impeller 60 surface along a line intermediate to the circumferentially spaced edges 76 and 77 of the outlet. In the ideal shape of FIG. 2, a radius from the centre of the scroll would, bisect the plane of the outlet substantially orthogonally. This geometry also results in the air stream emerging with a downward component of motion when the outlet is oriented vertically, as in FIG. 7.

As seen in the table above, the cutback scroll design reduces the number of modes of vibration of the scroll below 650 Hz (those likely to be excited by motor pulsation harmonics) from five to two and the new shape exhibits little vibration along the "free" outer edge of the scroll. However, in order to further reduce noise from the motor, vibration isolation of the motor/impeller assembly is needed. In the fan of FIGS. 7 to 9, this is achieved by attaching the motor mounting frame 80 to the scroll side wall 72 by means of three grommets 81. The grommets are selected to have the necessary axial and radial resonant frequencies to isolate the scroll from the remaining motor pulsation frequencies.

The mounting frame 80 is moulded from a plastics material and consists of an annular outer plate 82, having location slots 83 for three grommets, and a cage portion 84 extending axially into the scroll. Cage portion 84 includes four angle-sectioned ribs 85 each terminating in fingers 86 which locate in complementary cut-outs in the support body 53 and printed circuit board 54 to support the motor.

Sound power measurements, made in accordance with ISO 7779 (Measurement of Airborne Noise Emitted by Computers and Business Equipment) for free field measurements over reflecting place using a hemispherical measurement surface, were taken for the following fan configurations:

1. The original design with hard mounted motor/impeller assembly in a typical user situation integral with two BLDC motored centrifugal fans mounted on a fan plate, and
2. As (1) using the final unit fan design shown in FIGS. 7 to 9 with the fan scrolls spot welded to the fan plate, and
3. The final fan design measured at the unit level.

Figure 10:
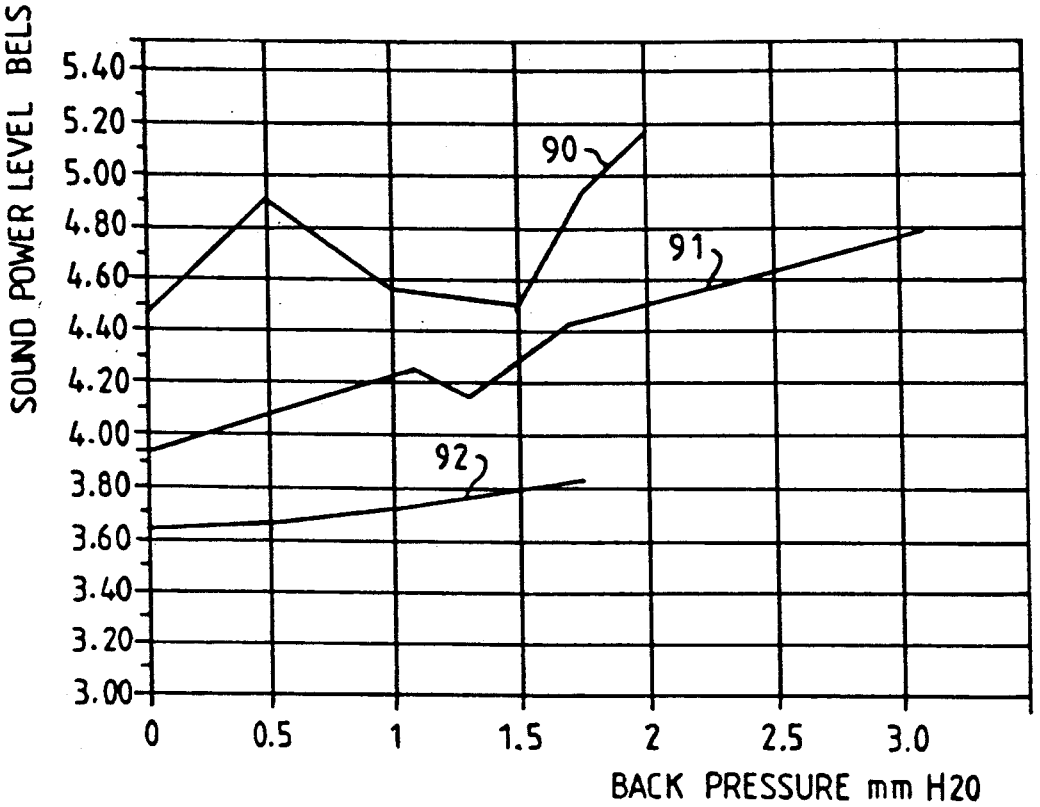
FIG. 10 shows curves of sound pressure against back-pressure for the fan of FIGS. 7 to 9 in comparison with a hard mounted fan.

The results are shown in FIG. 10 where 'A' weighted sound power in bels is plotted against back pressure in mm water. Curve 90 corresponds to the first fan configurations and curves 91 and 92 to the second and third configurations.

The results clearly show that for the final design the increase in sound power with back pressure is near linear for both the single unit and the dual fan assembly, the motor pulsation frequency which caused a variation of up to 7 dB on the initial design being eliminated.

Figure 11:
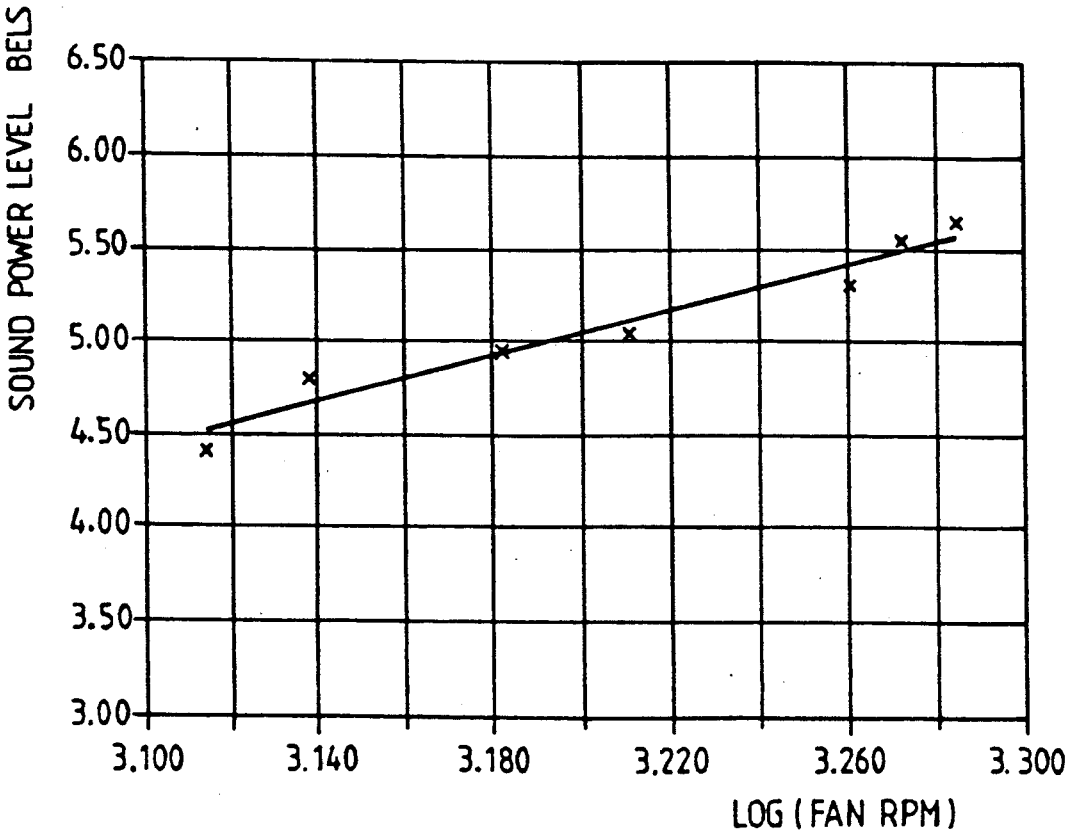
FIG. 11 shows the variation of sound power level with log (fan rpm) for the fan of FIGS. 7 to 9.

Furthermore if the sound power is plotted against Log (fan rpm) for the final design dual fan assembly (FIG. 11), the linear regression equation is given by:

$$Lw = 6.1619 \times \log(\text{fan rpm}) - 14.68$$

which is in close agreement with the 6th power law for an aerodynamic dipole which is the dominate type if source in low speed centrifugal fans. This shows that the aerodynamic noise is now dominant and further noise reduction can only be achieved by improved impeller blade and fan scroll intake design.

Thus, in the fan of FIGS. 7 to 9, the use of a 45° outlet scroll combined with vibration isolation of the motor-/impeller assembly, reduces motor noise to a level where aerodynamic noise is dominant over a wide range of operating pressures and air flows.

The final design in a duplex fan assembly running at 12 volts has a very low 'A' weighted sound power level which varies consistently with back pressure from 3.97 bels at free flow to 4.50 bels at 2 mm of water at an air flow delivery of 25 liters/sec.

Figure 12:
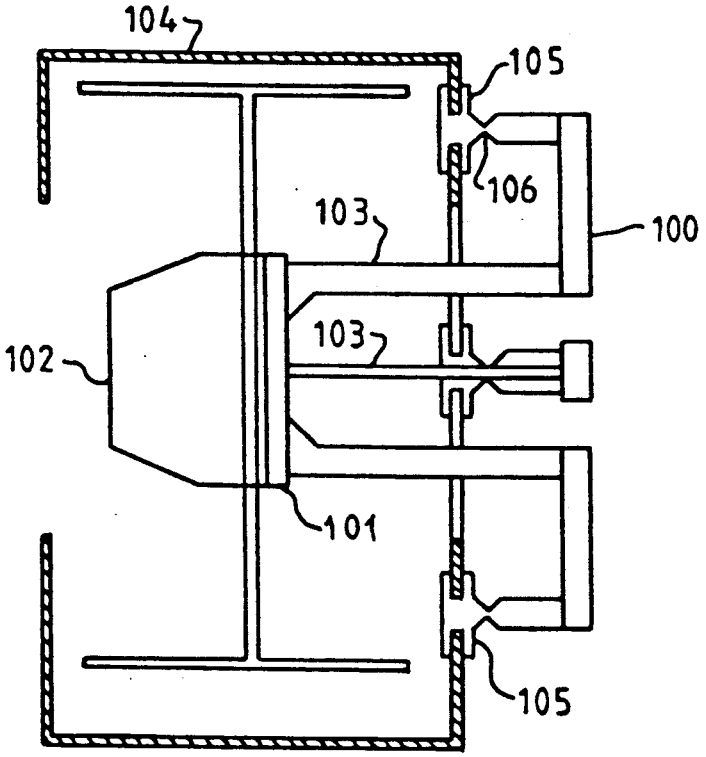
FIG. 12 shows a schematic sectional view of a centrifugal fan according to the invention employing an alternative mounting arrangement for the motor.

FIG. 12 shows schematically an alternative motor mounting frame which may be substituted for frame 80 of FIGS. 7 to 9. In the alternative structure the frame 100 is moulded from a heavy rubber and comprises a base portion 101 bonded to the motor 102. Three legs 103 extend from the base outwardly through an air inlet in scroll 104 and are turned through U-bends to terminate in feet 105. The ankle portion 106 above each foot is necked to form an isolation mount. The shape of the portion 106 determines the relative axial to radial stiffness and is determined by the motor pulsation frequency harmonies.

What is claimed:

1. A centrifugal fan comprising:

a brushless direct current motor;

an impeller mounted on said brushless direct current motor for rotation thereby; and a scroll for mounting said brushless direct current motor, said scroll defining an air inlet, an air outlet and including an outer wall curved around said impeller to define a divergent path to said air outlet for air driven by said impeller, said scroll being truncated at said air outlet so as to form a plane at said air outlet which is substantially orthogonal to a radius of said scroll.

2. The centrifugal fan according to claim 1, in which said outer wall of said scroll is completely curved.

3. The centrifugal fan according to claim 1, wherein said air outlet includes a substantially rectangular aperture and wherein said scroll includes coplanar flanges extending outwardly from said substantially rectangular aperture for mounting said centrifugal fan.

4. The centrifugal fan according to claim 1, wherein said scroll includes two sidewalls, each of said two sidewalls including an aperture to provide an air inlet.

5. The centrifugal fan according to claim 1, in which said brushless direct current motor is resiliently mounted on said scroll.

6. The centrifugal fan according to claim 5, wherein said scroll includes a sidewall and said centrifugal fan includes a motor support frame resiliently connected to said sidewall and extending axially into said scroll, within said impeller, to support said brushless direct current motor.

7. The centrifugal fan according to claim 6, wherein said motor support frame includes an outer plate, co-extensive with said sidewall, and a cage portion extending axially into said scroll and rigidly connected to said brushless direct current motor, said resilient connection provided by a plurality of circumferentially disposed vibration isolators between said outer plate and said sidewall.

8. The centrifugal fan according to claim 7, wherein said sidewall includes an aperture to provide an air inlet and wherein said outer plate of said motor support frame is annular in shape so as to minimize obstruction of said air inlet within said sidewall.

9. The centrifugal fan according to claim 7, wherein said motor support frame is made of an elastomeric material to provide vibration isolation.

10. The centrifugal fan according to claim 7, in which said motor support frame comprises three legs connecting a base portion to respective feet disposed within said sidewall.

11. The centrifugal fan according to claim 10, in wherein each of said legs is reduced in thickness adjacent said respective feet to provide further vibration isolation.

* * * * *